United States Patent [19]

Moll

[11] Patent Number: 4,496,339

[45] Date of Patent: Jan. 29, 1985

[54] APPARATUS FOR SETTING ROLLER CLEARANCE

[76] Inventor: Richard J. Moll, c/o Dick Moll & Sons 415 Constance Dr., Warminster, Pa. 18974

[21] Appl. No.: 485,730

[22] Filed: Apr. 18, 1983

[51] Int. Cl.[3] ..... B65H 45/14

[52] U.S. Cl. ..... 493/420; 271/274

[58] Field of Search ..... 271/272, 273, 274; 493/420, 421

[56] References Cited

U.S. PATENT DOCUMENTS

| | | | |
|---|---|---|---|
| 2,503,858 | 4/1950 | Waterworth | 493/420 |
| 2,699,331 | 1/1955 | McGarvey et al. | 493/421 |
| 3,021,134 | 2/1962 | Appell | 493/420 |
| 3,328,026 | 6/1967 | Bartizal, Jr. | 493/420 |
| 4,032,133 | 6/1977 | Steffens et al. | 493/421 |

*Primary Examiner*—W. D. Bray

*Attorney, Agent, or Firm*—Z. T. Wobensmith, III

[57] ABSTRACT

Apparatus for setting roller clearances is disclosed, particularly suitable for folding machines, in which the desired clearance between adjacent rollers can be set at a predetermined thickness, with contact pressure between the rollers at a desired amount, and which clearance can be easily varied for different thicknesses of paper to be folded.

5 Claims, 4 Drawing Figures

APPARATUS FOR SETTING ROLLER CLEARANCE

BACKGROUND OF THE INVENTION

1. Field of the Invention

This invention relates to apparatus for setting roller clearances in machines for folding paper and the like.

2. Description of the Prior Art

Apparatus for setting roller clearances are well known in the art. Several variations are available, all of which provide for pre-adjustment of roller clearances by manual adjustment of a coil spring for each thickness of paper to be folded and which are difficult to manipulate. The typical folding machine has pairs of rollers, in number at least 4 rollers and most machines have 6 rollers, each pair of rollers (one stationary and one movable) have fold plates associated therewith. The rollers must be set at clearances sufficient to permit paper of a selected thickness to pass therethrough for folding, but close enough to exert sufficient pressure to move the paper without mishap. The paper as it is folded into the brochure or other folded article is in increasing thicknesses between each consecutive set of rollers and fold plates and, accordingly, the clearances must be different between the respective sets of movable and stationary rollers as the brochure moves through the folding machine.

In a typical folding machine such as shown in the U.S. Pat. No. 3,021,134 to G. T. APPELL, a roller hanger bracket 12 is shown having an arm 30 which a threaded rod 38 is engaged, with a spring 48 engaged therewith and with a knurled seat 50 bearing on the spring 48, maintaining predetermined tension on arm 30, and which rod 38 is engaged in a bracket 60. The rod 38 can be rotated to put spring pressure on arm 30, but when rotated in the opposite direction to move arm 30 for a new thickness of paper, relieves the tension on arm 30. The spring 48 length must then be changed to provide the required pressure on arm 30 for the new paper thickness.

The U.S. Patent to STEFFENS, et al., No. 4,032,133, illustrates a method and apparatus for roller positioning, which the same type of resilient structure 80 with a threaded rod and extension 82 with the same limitations of setting the spring tension upon rotation of the rod for different thickness of paper to be folded.

With the apparatus as shown in U.S. Pat. Nos. 3,021,134 and 4,032,133, each paper and spring arm pressure clearance must be set by trial and error, and these clearances are not easily changed. With the apparatus of my invention, actual specimens of the paper to be folded in number corresponding to the folds at each set of rollers are used for setting the roller clearances, and the predetermined spring pressure on the roller arm does not normally require change for different thicknesses of paper. The apparatus is easy to use and does not suffer from the shortcomings of the prior available structures.

SUMMARY OF THE INVENTION

In accordance with the invention, apparatus for setting roller clearances is provided for use in folding machines at various locations for setting clearances between adjacent rollers at predetermined contact pressure, and which clearances can be easily changed for different thicknesses of paper to be folded.

The principal object of the invention is to provide apparatus for setting clearances between rollers which can be used with a variety of folding machines and at different locations throughout the machines.

A further object of the invention is to provide apparatus of the character aforesaid which is simple to use, positive in operation and uses specimens of the paper to be folded to determine the clearances.

A further object of the invention is to provide apparatus of the character aforesaid which can have predetermined tension on the rollers maintained regardless of paper thickness.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely, and that various modifications and changes can be made in the structure disclosed without departing from the spirit of the invention.

Like numerals refer to like parts throughout the several views.

DESCRIPTION OF THE PREFERRED EMBODIMENT

Figure 1:
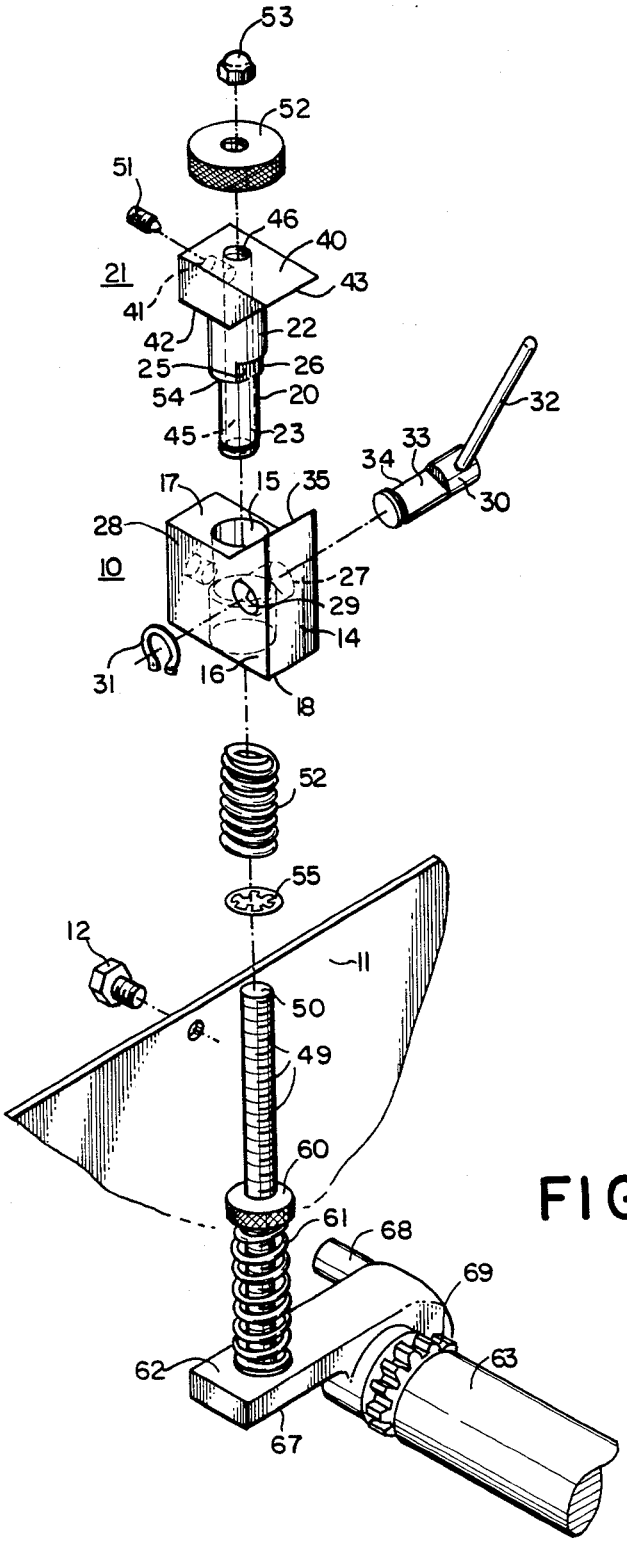
FIG. 1 is an exploded perspective view of the apparatus for setting roller clearances in accordance with the invention.
Figure 2:
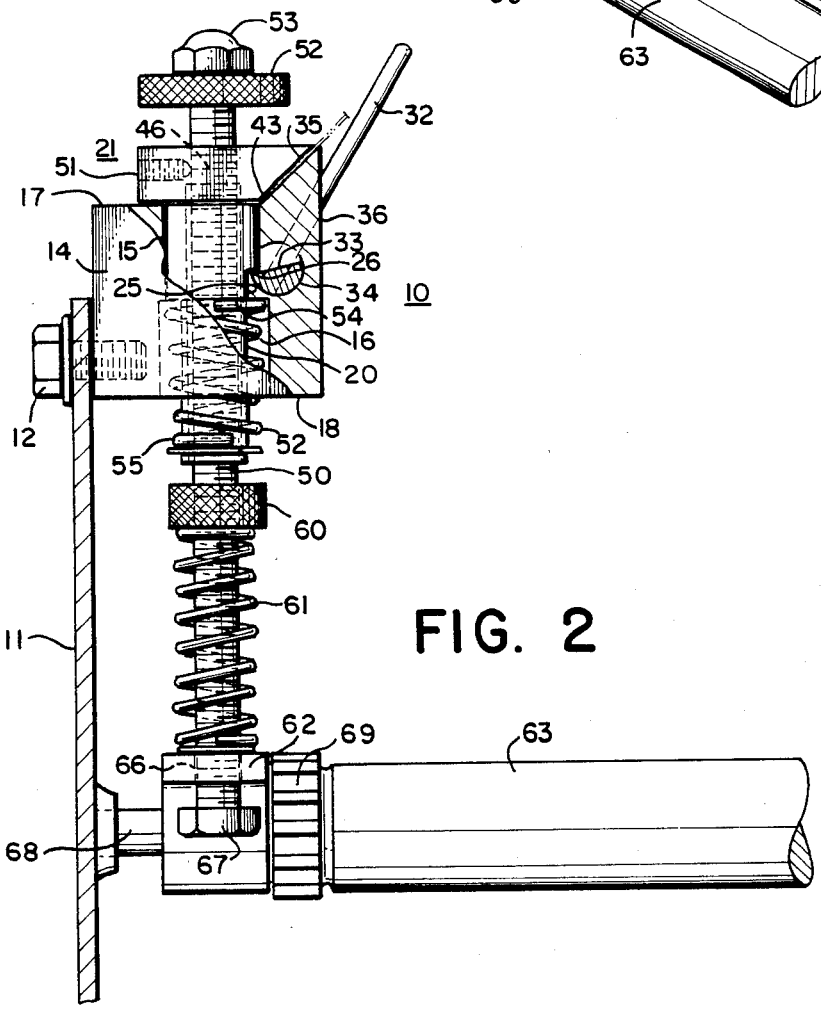
FIG. 2 is a side elevational view in partial section of the apparatus in accordance with the invention.

Referring now more particularly to the drawings and FIGS. 1 and 2 thereof, the apparatus 10 is shown mounted to the side plate 11 of a folding machine (not shown) of well known type, by a bolt 12 engaged in the stem block 14 of the apparatus 10. The block 14 is of generally rectangular configuration with an upper vertical cylindrical passageway 15 therein, in communication with a lower axial aligned cylindrical passageway 16, extending from top wall 17 to bottom wall 18. The passageways 15 and 16 have an extension 20 from a gage block 21 extending therethrough, which extension 20 is of cylindrical configuration, and includes a portion 22 and a portion 23 of reduced diameter. The portion 22 has a cutout 25 extending transversely across it and providing a shoulder 26. The body 14 has a passageway 29 extending perpendicularly to opening 15 from side wall 27 to side wall 28, which has a transverse shaft 30 retained therein by C-Clip 31, and with an actuation arm 32 engaged with the shaft 30. The shaft 30 has a flat central portion 33 with a shoulder 34, which can engage the shoulder 26 upon counterclockwise movement of arm 32 and rotation of transverse shaft 30, which causes the extension 20 and block 21 to be moved vertically upwardly for purposes to be explained. The shaft 30 is preferably formed of hardened steel.

The stem block 14 adjacent top wall 17 has an angularly related upwardly extending wall 35 which intersects a vertical front wall 36.

The gage block 21 includes an upper portion 40 of generally rectangular shape with top and bottom walls 41 and 42, with a front angularly related wall 43 connecting the top and bottom walls at the same angle as wall 35. The gage block 21 has a vertical passageway 45 therein with an upper threaded passageway 46 of reduced diameter which is normally engaged by threads 49 of stem 50 and retained in passageway 46 by a set screw 51. An adjustment nut 52 is provided on stem 50 retained thereon by an accorn nut 53. The stem block 14 and the gage block 21 are preferably formed of steel.

The extension portion 23 has a coil spring 52 thereon which is also carried in passageway 16, engaged with a shoulder 54 of extension portion 22, and with a toothed nut 55 carried on stem 50.

The stem 50 below nut 55 has a knurled spring nut 60 thereon, engaged with threads 49 and with a coil spring 61 thereon engaged with nut 60 and arm 62 from a roller 63 to be adjusted with respect to a stationary roller 65.

The stem 50 is engaged in an opening 66 in arm 62, and the arm 62 is retained from downward movement off stem 50 by nut 67, but is free to move upwardly along stem 50 against spring 61 upon upward pressure.

It should be noted that the coil spring 52 is selected to have a compression strength greater than that of spring 61, and upon compression of spring 61, spring 52 acts like a solid member in resisting compression from spring 61.

The arm 62 can be rotatably mounted to side plate 11 by shaft 68. The roller 63 can be of any desired type and is shown with a gear 69 thereon. The stationary roller 65 can also be of well known type and is rotatably mounted (not shown) to plate 11 in well known manner.

Figure 3:
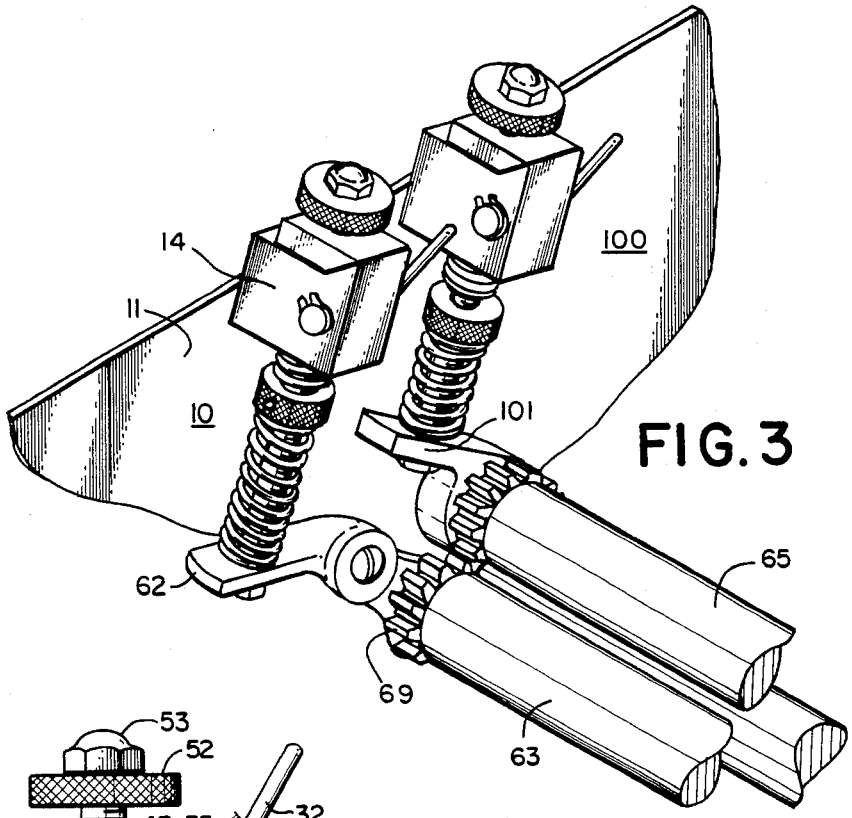
FIG. 3 is a view in perspective showing two of the apparatus at different locations on a machine.

Referring now to FIG. 3, a pair of apparatus 10 and 100 is illustrated as described for FIGS. 1 and 2 with the apparatus 100 mounted to an arm 101 that is longer than arm 62 and readily suitable for different locations in a folding machine.

Figure 4:
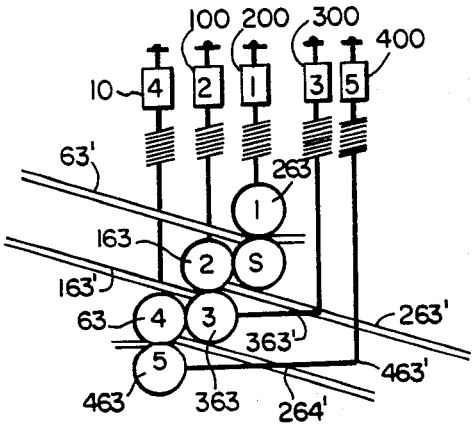
FIG. 4 is a diagrammatic view illustrating a plurality of apparatus at different locations on a machine.

Referring now to FIG. 4, apparatus, 10, 100, 200, are diagrammatically illustrated, connected respectively (not shown) to rollers 63, 163 and 263 with fold plates 63', 163' 263' and 264' associated therewith. Additional apparatus 300 and 400 are also illustrated and engaged with arms 363' and 463' carrying rollers 363 and 463 as described for FIGS. 1 and 2.

The mode of operation will now be pointed out. An apparatus 10 or 100, 200, 300 or 400 with operation as described for apparatus 10 is attached to the side plate 11 of a folding machine. The spring nut 60 is rotated to obtain the desired pressure between the rollers 63 and 65 so as to provide proper paper contact pressure.

A piece of the paper 110 to be folded (not shown) is inserted between the movable roller 63 and a stationary roller 65, and the arm 32 is moved to rotate shaft 30 and cause gage block 21 to be moved upwardly from stem block 14 against the force of spring 52, and a piece of paper 110 to be folded is inserted between walls 35 and 43. Arm 32 is released so that paper 110 is gripped between walls 35 and 43. The knurled adjustment nut 52 is rotated to provide the correct pressure between rollers 63 and 65. If different paper thicknesses are used or at other machine locations, it is necessary only to put a piece or pieces of the paper to be folded between gage block 21 and stem block 14, and it is normally not necessary to readjust spring nut 60.

When adjustment is complete, the set screw 52 is tightened and folding can commence. The apparatus 100, 200, 300 and 400 can be used as described for apparatus 10.

It will thus be seen that apparatus has been provided with which the objects of the invention are attained.

I claim:

1. In apparatus for setting roller clearances in machines for folding paper having at least one pair of rollers, said pair having one stationary roller and one roller axially movable therefrom with at least one arm extending from said movable roller, the improvement which comprises a stem block secured to said machine, said stem block having top and bottom walls, and a front wall, an angularly related wall connected to said top wall and said front wall, an upper and lower passageway extending from said top wall to said bottom wall, a transverse passageway in said block extending perpendicularly to said upper passageway, a shaft in said transverse passageway, said shaft including a central portion with a shoulder, actuation means engaged with said shaft for rotation thereof, a gage block, said gage block having an extension slidably engaged in said upper and said lower passageways, said gage block having top and bottom walls, a front angularly related wall connecting said gage block top and bottom walls at the same angle as said angularly related wall of said stem block, said gage block extension having a shoulder for engagement with said shoulder of said transverse shaft in said stem block, spring means on said extension, stem means engaged with said stem block and one of said roller arms, said stem means including spring means between said first mentioned spring means and said roller arm.

2. Apparatus as defined in claim 1 in which said stem means includes a threaded stem engaged with said stem block and said arm, said first mentioned spring means in said lower passageway around said stem shaft urges said stem block downwardly into engagement with said gage block, said first mentioned spring means being retained from downward movement on said stem shaft by a toothed nut, and said second mentioned spring means below said first mentioned spring means is engaged by an adjustment nut and one of said roller arms.

3. Apparatus as defined in claim 2 in which said first mentioned spring means is a coil spring, and said second mentioned spring means is a coil spring.

4. Apparatus as defined in claim 1 in which said first mentioned spring means has a greater compression strength than said second mentioned spring means.

5. Apparatus as defined in claim 1 in which said stem shaft upwardly of said stem block has an adjustment nut for rotation thereof.

* * * * *

UNITED STATES PATENT AND TRADEMARK OFFICE

CERTIFICATE OF CORRECTION

PATENT NO. : 4,496,339

DATED : January 29, 1985

INVENTOR(S) : RICHARD J. MOLL

It is certified that error appears in the above-identified patent and that said Letters Patent is hereby corrected as shown below:

Column 1,

Line 32, after "30", insert - with -,

Line 45, "which" should be - with -.

Column 4,

Line 19, after "and", insert - a -.

Signed and Sealed this

*Seventh* Day of *May 1985*

[SEAL]

*Attest:*

DONALD J. QUIGG

*Attesting Officer* *Acting Commissioner of Patents and Trademarks*